US005111947A

United States Patent [19]

Patterson

[11] Patent Number: 5,111,947

[45] Date of Patent: May 12, 1992

[54] TAMPER PROOF CAP AND CONTAINER

[76] Inventor: Michael C. Patterson, 2674 Maplewood Dr., Longview, Wash. 98632

[21] Appl. No.: 621,765

[22] Filed: Dec. 4, 1990

[51] Int. Cl.[5] ..... B65D 41/34

[52] U.S. Cl. ..... 215/256; 215/252; 215/254; 215/258

[58] Field of Search ..... 215/256, 254, 258, 252, 215/218, 219, 216

[56] References Cited

U.S. PATENT DOCUMENTS

| | | | |
|---|---|---|---|
| 3,310,191 | 3/1967 | Kern et al. . | |
| 3,415,403 | 12/1968 | Sardell . | |
| 3,812,994 | 5/1974 | Feldman | 215/256 |
| 3,850,329 | 11/1974 | Robinson . | |
| 3,901,404 | 8/1975 | Feldman | 215/256 |
| 3,902,621 | 9/1975 | Hidding . | |
| 3,955,696 | 5/1976 | Finke | 215/214 |
| 3,980,195 | 9/1976 | Fillmore | 215/256 |
| 4,062,466 | 12/1977 | Conti . | |
| 4,076,140 | 2/1978 | Perne | 215/256 |
| 4,131,212 | 12/1978 | Rumball | 215/256 X |
| 4,337,870 | 7/1982 | Keeler | 215/252 |
| 4,418,828 | 12/1983 | Wilde et al. | 215/252 |
| 4,480,761 | 11/1984 | Aichinger | 215/252 |
| 4,530,438 | 7/1985 | McDevitt . | |
| 4,534,480 | 8/1985 | Santostasi et al. | 215/252 |
| 4,550,845 | 11/1985 | Guala | 215/252 |
| 4,567,991 | 2/1986 | Anderson | 215/256 X |
| 4,572,388 | 2/1986 | Luker et al. | 215/252 |
| 4,573,598 | 3/1986 | Perry | 215/204 |
| 4,597,500 | 7/1986 | Stubbs | 215/258 |
| 4,646,926 | 3/1987 | Agbay et al. | 215/203 |
| 4,771,904 | 9/1988 | Perne et al. | 215/252 |
| 4,813,561 | 3/1989 | Ochs | 215/252 |
| 4,848,613 | 7/1989 | Nofer . | |
| 4,984,701 | 1/1991 | Margaria | 215/258 X |

FOREIGN PATENT DOCUMENTS

| | | | |
|---|---|---|---|
| 977312 | 12/1964 | United Kingdom | 215/254 |

*Primary Examiner*—Stephen Marcus
*Assistant Examiner*—Paul Schwarz
*Attorney, Agent, or Firm*—Klarquist, Sparkman, Campbell, Leigh & Whinston

[57] ABSTRACT

A tamper proof cap for use on container having a threaded neck. The cap includes a top portion, an annular skirt portion depending from the top portion and a separable strip depending from the bottom of the skirt portion. The boundary between the skirt portion and separable strips is defined by a line weakness. The skirt portion has internal threads that complement threads on an upper portion of the container neck. A portion of the separable strip has internal teeth that engage notches on a lower portion of the container neck. At the end of the strip is a tab which is grasped and pulled to sever the strip from the skirt along the line of weakness, thereby allowing the skirt portion to be unthreaded. The teeth of the strip and the container notches are constructed to allow the teeth to slide past the notches upon rotation of the cap in clockwise threading direction while causing the teeth to engage the notches to prevent rotation of the cap in a counterclockwise unthreading direction.

12 Claims, 3 Drawing Sheets

TAMPER PROOF CAP AND CONTAINER

BACKGROUND OF THE INVENTION

This invention relates generally to threaded caps and containers. More particularly, the invention relates to caps and containers that are tamper proof in the sense that any tampering with the cap when sealed to the container is clearly visible.

Tamper proof caps are used in food and drug packaging to indicate to a prospective purchaser whether the cap on a container has been removed and replaced. These caps come in a variety of types, as illustrated in the following patents.

U.S. Pat. No. 4,337,870 to Keeler discloses a threaded cap joined to a sealing ring by frangible bridges. The ring includes ratchet segments that engage pawl teeth on the container neck with the cap closed. To open the container, the cap is turned counterclockwise with sufficient force to shear the bridges.

U.S Pat. No. 4,418,828 to Wilde et al. discloses a cap having a threaded skirt to which is attached, by a fracturable area, a pilfer band. As the cap is unthreaded, the band catches against the bottom surface of a locking ring on the container neck. Continued unthreading of the cap causes the fracturable area to fracture and the pilfer band to tear free of the skirt portion.

U.S. Pat. No. 4,480,761 to Aichinger discloses a cap similar in design to Wilde et al. The cap includes a closure portion to which is joined a guarantee strip by rupturable web portions. With the cap in its closed position, the guarantee strip engages the bottom of a container neck ring. Unscrewing the cap causes the strip to tear away from the closure portion, indicating that the cap has been removed.

U.S. Pat. No. 4,550,845 to Guala describes a bottle closure having a cap portion and a collar portion joined to the cap portion at a line of weakness. The collar portion has internal teeth that engage complementary teeth on the bottleneck with the closure in the closed position. When the cap is unscrewed, the collar is separated therefrom at the line of weakness and remains on the bottleneck.

U.S. Pat. No. 4,646,926 to Agbay et al describes a screw-on cap held in place on a container by a rotary safety ring. The ring must be aligned with the cap on one angular position and pushed downwardly away from the cap before one can remove the cap from the container. A tear tab is attached to the container neck below the ring to prevent the ring from being lowered. Thus a missing tear tab indicates that the bottle has been opened or tampered with.

U.S. Pat. No. 4,572,388 to Luker et al discloses a cap having a threaded upper skirt connected to a lower tamper indicating band by breakable bridge members. In one of the embodiments shown, the band has stop segments connected to its the lower edge. As the cap is threaded onto the container, the stop segments swing inwardly to pass over ratchet teeth on the container neck. Upon rotation of the cap in an unthreading direction, the stop segments engage the ratchet teeth to prevent further rotation of the band. Further rotation of the upper skirt causes the breakable members to fracture, allowing the cap to be removed while the band remains on the neck.

While these various caps have generally worked, they have a number of drawbacks. For one, they are expensive to mount. Caps with bottom rings require special machinery for proper mounting. For another, their protection can be circumvented. A removed cap can be replaced on a container and positioned over its sealing ring or band so as to appear to have been never removed.

The present invention has neither of these drawbacks. The cap can be mounted in a customary manner, and yet its removal and replacement are readily evident.

SUMMARY OF THE INVENTION

An object of the invention, therefore, is to provide an improved tamper proof cap and container.

Another object of the inventions is to provide a tamper proof cap that can be mounted to a container in the usual and ordinary manner without special machinery.

Yet another object of the invention is to provide a tamper proof cap and container in which tampering with the cap is readily evident.

In accordance with these objects, a cap comprises a top portion from which an annular skirt portion depends. The skirt portion contains threads complementary to threads on a container to which the cap is to be mounted. Depending from the bottom of the skirt portion is a separable strip. The boundary between the strip and skirt portion is defined by a line of weakness in the cap material. The strip includes means for grasping the strip to sever it from the skirt portion along the line of weakness.

The cap is held to the container by an interlocking tooth and notch arrangement, one portion of the arrangement on the container neck and the other portion of the arrangement on a portion of the separable strip. The arrangement is constructed to allow the teeth to slide past the notches upon rotation of the cap in a threading direction while causing the teeth to engage the notches to prevent rotation of the cap in an unthreading direction. Only when the strip is severed from the annular skirt portion can the skirt portion be unthreaded.

The foregoing and other objects, features, and advantages of the invention will become more apparent from the following detailed description of several preferred embodiments which proceeds with reference to the accompanying drawings.

DESCRIPTION OF PREFERRED EMBODIMENTS

Figure 1:
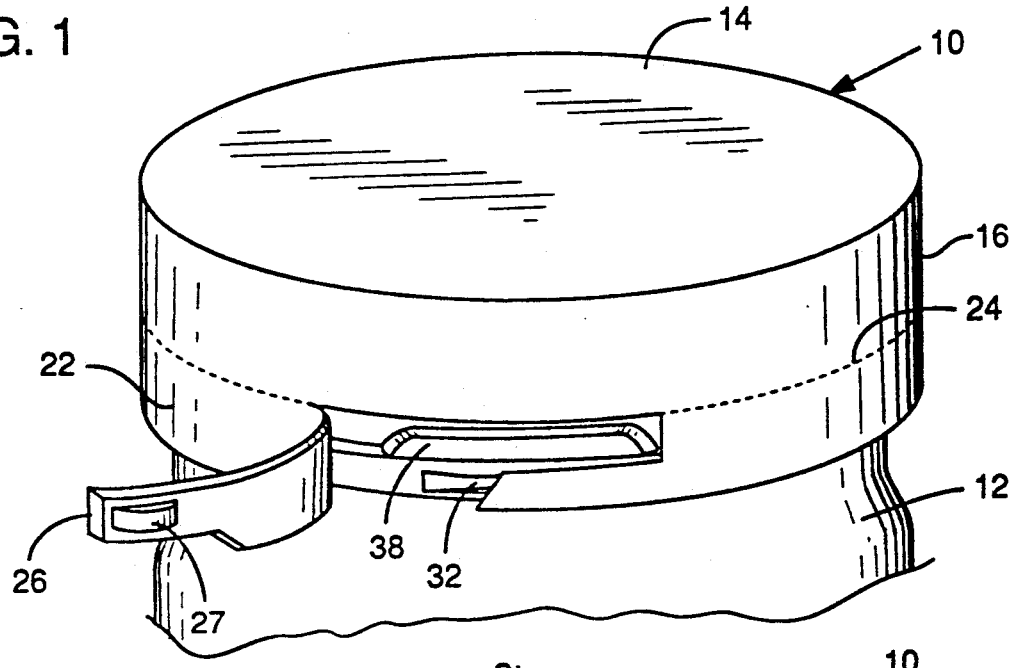
FIG. 1 is a perspective view of a tamper proof cap according to the invention, with the tab on the separable strip pulled back.
Figure 2:
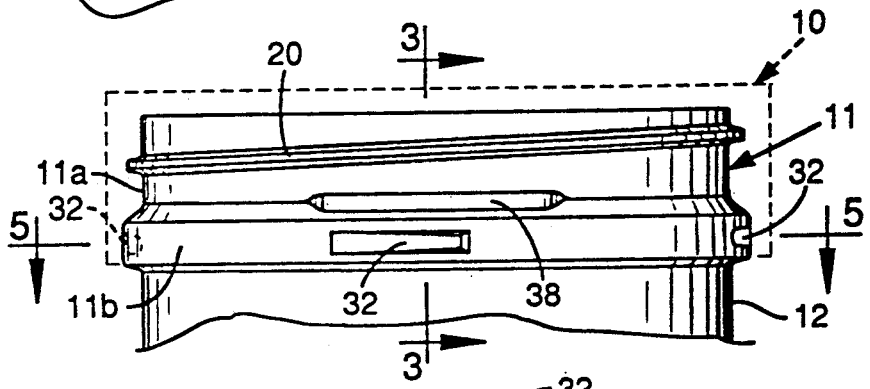
FIG. 2 is a side view of a bottle neck according to the invention.
Figure 3:
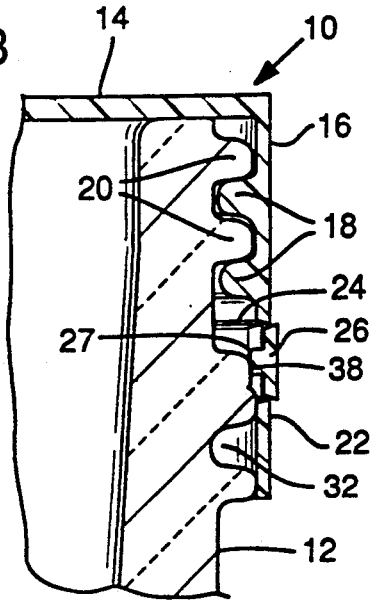
FIG. 3 is a cross sectional view of the engaged bottle neck and cap taken along lines 3—3 of FIG. 2.

Referring now to FIGS. 1-3, there is shown a first embodiment of a tamper proof cap 10 threadably mounted to the neck 11 of a container 12. The cap 10 is made of a pliable material such as plastic. The cap 10 comprises a circular top portion 14 from which depends an annular skirt portion 16. The skirt portion 16 has internal threads 18 that complement container threads 20 for screwing the cap 10 onto the container 12.

Figure 4:
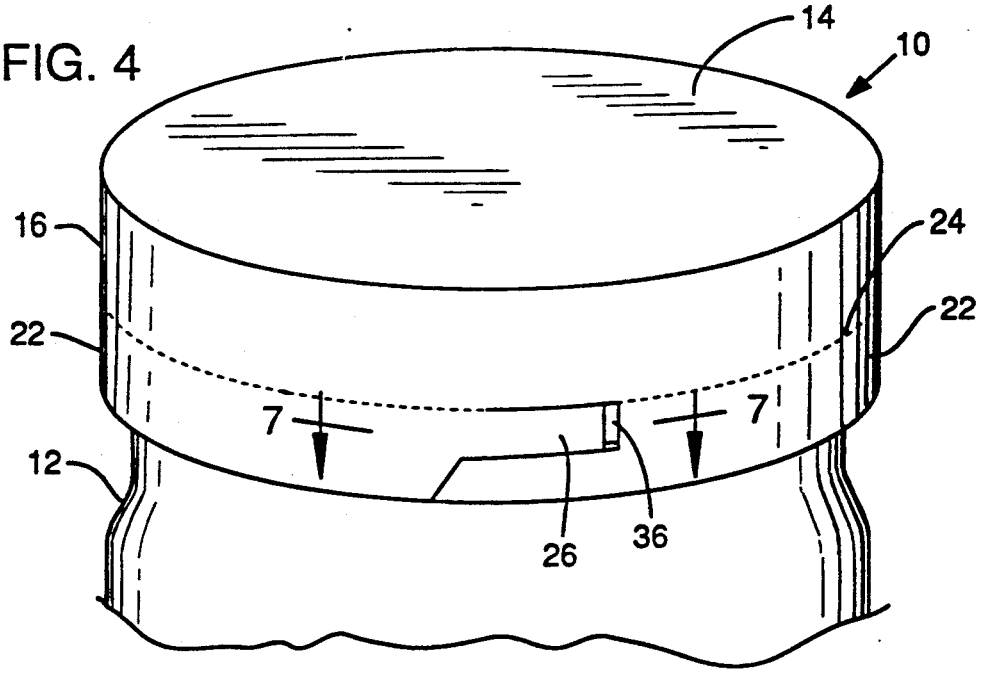
FIG. 4 is another perspective view of the cap, with the separating tab as it rests circularly aligned with the rest of the cap.

Depending from the bottom of the skirt portion 16 is a separable strip 22. In this embodiment, the separable strip is constructed to be entirely removed from the neck 11 upon severing the strip from skirt portion 16. The boundary between skirt portion 16 and the strip 22 is defined by a line of weakness 24 in the cap material. To sever and thus separate the separable strip 22 from skirt portion 16, grasping means such as a tab 26 form a free end of the strip. On the inside of tub 26 is a protrusion 27. FIG. 4 illustrates how the tab 26 is substantially circularly aligned with the strip 22 when not being grasped.

Figure 5:
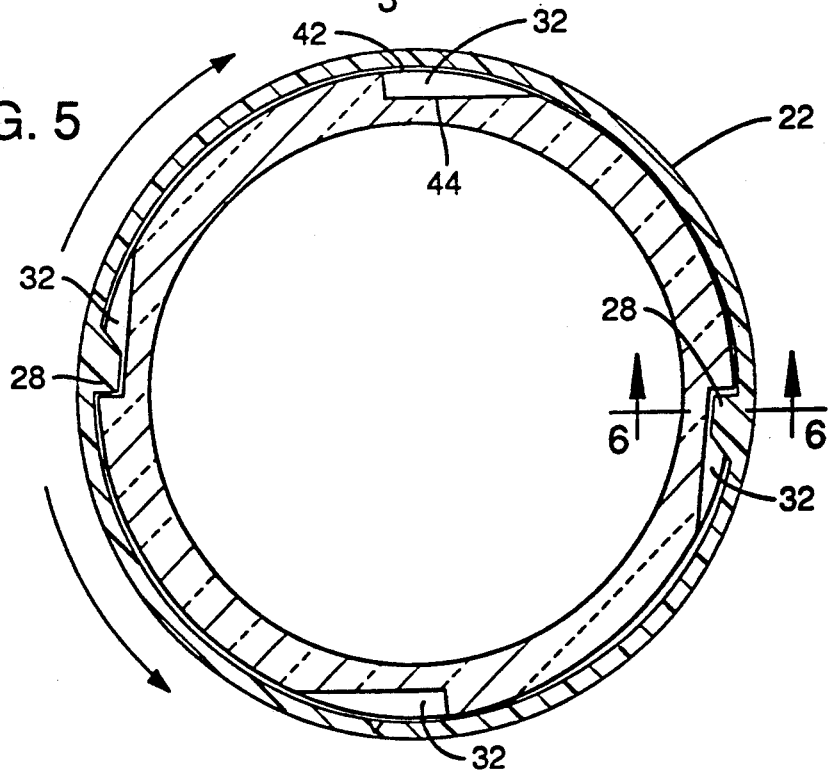
FIG. 5 is a cross sectional view of the bottle neck taken along lines 5—5 of FIG. 2.
Figure 6:
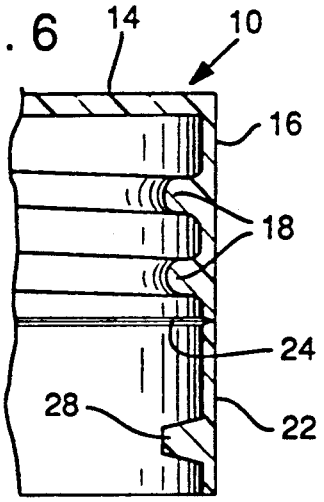
FIG. 6 is a cross sectional view of the cap taken along lines 6—6 of FIG. 5 with the bottle removed.

Means are provided for interlocking the cap 10 to the container neck 11 to prevent leakage of the container's contents. This is best seen in FIGS. 3, 5 and 6. FIG. 6 is a cross sectional view of the cap 10 alone, while FIG. 3 is a cross sectional view of the cap threaded to container neck 11. The separable strip 22 includes on its lower portion a pair of opposing internal teeth 28 designed to interlock with notches 32 defined within the neck 11 of container 12. The teeth 28 and notches 32 form two portions of an interlocking tooth and notch arrangement below the container threads 20 on the neck 11. As evident from FIG. 5, the teeth 28 and notches 32 are constructed in pawl-like fashion. This allows the teeth to slide past the notches upon rotation of the cap in a clockwise, threading direction while causing the teeth to engage the notches to prevent rotation of the cap and a counterclockwise, unthreading direction. In the present embodiment the notches 32 are defined within the container neck 11 and the teeth 28 are formed internally on the separable strip 22. However, this may be reversed, with the teeth defined within the container neck 11 and the notches defined with the strip 22 if desired.

Figure 7:
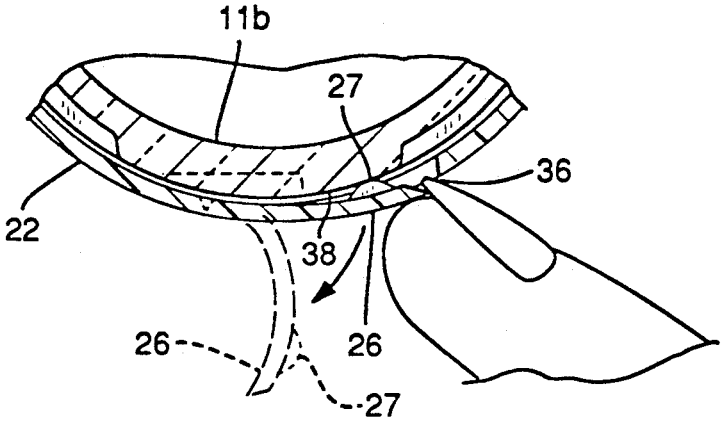
FIG. 7 is a cross sectional view of the cap taken along lines 7—7 of FIG. 4.

As shown in FIG. 4, the tab 26 is substantially circularly aligned with the rest of strip 22 when the cap 10 is threaded onto the neck 11. To permit grasping of tab 26, the strip 22 defines a small gap 36 between the end of the tab 26 and the adjacent portion of the separable strip. This permits a person to grasp the tab 26 as shown in FIG. 7. The container 12 may also include a protrusion 38, (FIGS. 1 and 2) positioned on the neck 11 below the threads 20. The protrusion 38 engages protrusion 27, forcing the tab 26 slightly outward from the strip when the cap 10 is threaded completely onto neck 11 and the teeth 28 are engaged with container notches 32. To remove the cap 10, one grasps the tab 26 as shown in FIG. 7 and pulls it outwardly and around the neck 11, as shown in FIG. 1. The action severs the strip 22 from the skirt portion 16 along the line of weakness 24, thereby allowing the skirt portion to be unthreaded from the container neck 11.

FIGS. 2 and 5 show the container neck 11 in greater detail. The neck 11 includes an upper annular portion 11*a* that contains the threads 20 that complement the threads 18 of the cap 10. Below the threads 20 is a lower annular portion 11*b* (of slightly greater diameter then the upper portion 11*a*) in which the notches 32 are defined. Each notch 32 has a first substantially radially extending surface 42 and a second surface 44 extending from the circumference of the second portion to intersect the surface 42 at substantially a right angle. The notches 32 are all situated in a single plane through the container 12 perpendicular to container's longitudinal axis.

An advantage of a tamper proof cap constructed according to the invention is the ease of mounting it on a container. Unlike prior caps that include sealing rings which require special mounting equipment, the cap 10 can be mounted by threading it on to the container 12 in a customary manner with a minimal effort. With reference to FIG. 5, as the cap 10 is threaded clockwise, the internal teeth 28 slide along the annular neck portion 11*b* and over the notches 32. The four notches 32 are spaced 90° apart on container to engage a tooth 28. This spacing allows a cap to be tightened sufficiently to prevent leakage without being overtightened to the point of damaging the cap's structure.

A second advantage of the cap 10 is the need to remove the strip 22 in order to unthread the cap from the container neck 11. The line of weakness 24 is of sufficient strength to prevent the mere twisting of the cap off the container with the strip 22 still in place. A force of magnitude sufficient to otherwise remove the cap with the strip in place would permanently deform the cap to a point that the tampering would be clearly evident. Many tamper proof caps of prior design rely on the user twisting the cap with sufficient force to break bridge structure between the cap and the sealing ring. However, such caps can be replaced on the container neck and realigned with the sealing such that the cap's removal is not easily detected. In contrast, any tampering with cap 10 is readily evident by lack of the strip 22.

Figure 8:
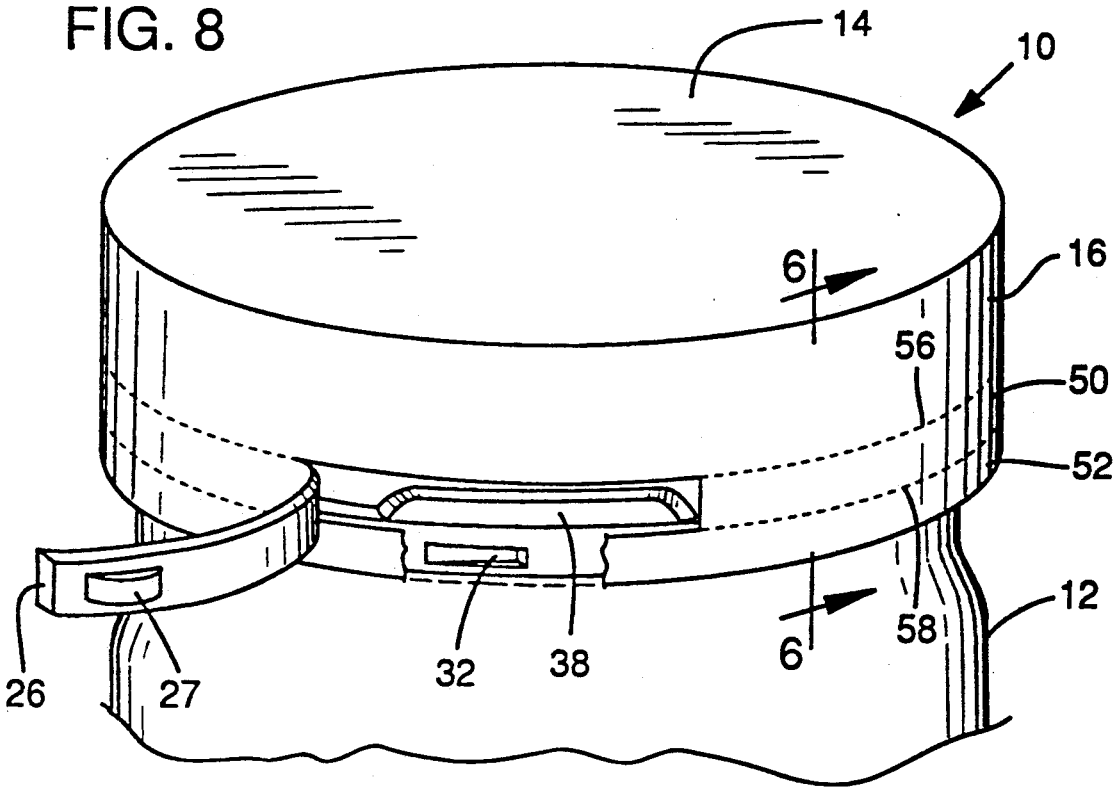
FIG. 8 is a perspective view of a second embodiment of a tamper proof cap according to the invention.
Figure 9:
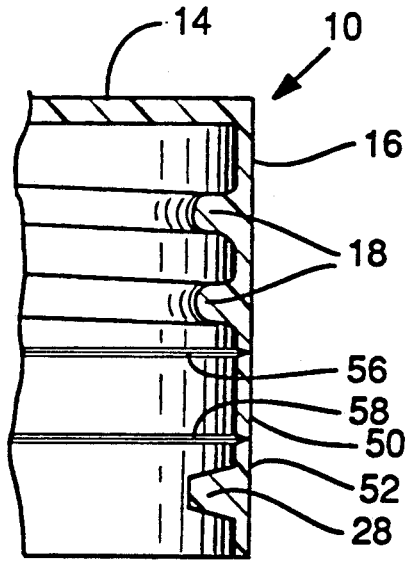
FIG. 9 is a cross sectional view of the cap of FIG. 8.

A second embodiment of a cap according to the invention is shown in FIGS. 8 and 9, where the same reference numerals are used for elements present in common with the first embodiment. In this embodiment a portion of the separable strip remains attached to the container neck as a second skirt portion upon severing the strip from the skirt portion 16. Appearing in place of the separable strip 22 are an intermediate separable strip 50 and a second annular skirt portion 52. The strip 50 depends from the bottom of the first skirt portion 16, the boundary between the first skirt portion and the strip being defined by a first line of weakness 56. The annular skirt portion 52 depends from the bottom of the strip 50, the boundary between the two being defined by a second line of weakness 58. The skirt portion 52 has internally one portion of the tooth and notch arrangement to engage the other portion defined on the annular portion 11*b* of the container neck. As shown in FIGS. 8 and 9, in this embodiment the second skirt portion 5 includes internally the teeth 28 and the container neck 11 defines the notches 32. As in the first embodiment, strip 50 includes an internal protrusion 27 that engages the protrusion 38 of the container neck 11 when the cap is threaded completely onto the neck.

This second embodiment has the advantages of the first embodiment, plus the fact that tampering with the cap 10 is even more evident. If the strip 50 is removed, the resultant gap between the first skirt portion 16 and the second skirt portion 50 clearly indicates tampering.

Having illustrated and described the principles of the invention in a preferred embodiment, it should be apparent to those skilled in the art that the invention can be modified in arrangement and detail without departing from such principles. We claim all modifications coming within the spirit and scope of the following claims.

I claim:

1. A tamper proof cap for use on a container having a threaded neck and one portion of an interlocking tooth and notch arrangement of spaced-apart teeth and notches below the threads, comprising:

a top portion;

an annular skirt portion depending from the top portion and having internal threads complementary to the container threads;

a separable strip depending from the bottom of the skirt portion and having internally the other portion of the tooth and notch arrangement of spaced-apart teeth and notches, a boundary between the skirt portion and separable strip defined by a line of weakness; and means for grasping the separable strip to sever it from the skirt portion along the line of weakness, thereby allowing the skirt portion to be unthreaded, the notches each being constructed with a first surface extending substantially perpendicularly inward from the circumference of the neck or annular portion wherein the notches are defined and a second surface extending from the circumference of the neck or annular portion to intersect the first surface at substantially a right angle, the notches positioned to allow the teeth to slide past the notches upon rotation of the cap in a threading direction until the cap reaches a sealed position on the container threads, the teeth thereby engaging the notches to prevent rotation of the cap from the sealed position in an unthreading direction.

2. The tamper proof cap of claim 1 wherein the strip is constructed to be removed from the container neck upon severing the strip from the skirt portion.

3. The tamper proof cap of claim 1 wherein a portion of the strip remains attached to the container neck upon severing the strip from the skirt portion.

4. The tamper proof cap of claim 1 wherein the notches of the interlocking arrangement are defined within the container neck and the teeth are formed internally on the separable strip.

5. The tamper proof cap of claim 1 wherein the grasping means comprises a tab at one end of the separable strip.

6. The tamper proof cap of claim 1 wherein the container contains a protrusion positioned on the container neck for forcing the grasping means outward from the strip when the teeth are engaged with the container notches.

7. The cap of claim 1 wherein the teeth and notches are equally spaced apart.

8. A container neck for an internally threaded cap having spaced-apart internal teeth, comprising:

a first annular portion threaded for engaging the threads of the cap; and a second annular portion below the first into which spaced-apart notches are defined, each notch having a first surface extending substantially perpendicularly inward from the circumference of the second annular portion and a second surface extending from the circumference to intersect the first surface at substantially a right angle, the notches all situated within a common elevational plane through the container perpendicular to its longitudinal axis, the internal teeth of the cap and the container notches being constructed and positioned to allow the teeth to slide past the notches upon rotation of the cap in a threading direction until the cap reaches a sealed position on the container threads, the teeth thereby engaging the first surfaces of the notches to prevent rotation of the cap from the sealed position in an unthreading direction.

9. A system for detecting tampering with a capped container, comprising:

(a) a container neck having a threaded annular portion, a notched annular portion below the threaded portion and having spaced-apart notches therein and protrusion between the two neck portions, each notch having a first surface extending substantially perpendicularly inward from the circumference of the notched annular portion and a second surface extending from the circumference of the notched annular portion to intersect the first surface at substantially a right angle; and (b) a cap comprising:

a top portion;

an annular skirt portion depending from the top portion and having internal threads complementary to the threads of the threaded annular portion of the container; and a separable strip depending from the bottom of the skirt portion, a boundary between the skirt portion and strip defined by a line of weakness, a portion of the strip including spaced-apart internal teeth for engaging the spaced-apart notches of the notched annular portion of the container, the internal teeth of the separable strip and the container notches being constructed and positioned to allow the teeth to slide past the notches upon rotation of the cap in a threading direction until the cap reaches a sealed position on the container, the teeth thereby engaging the notches to prevent rotation of the cap from the sealed position in an unthreading direction, the engagement preventing unthreading of the cap from the container neck until the separable strip is severed from the cap along the line of weakness.

10. The system of claim 9 wherein the teeth and notches are equally spaced apart.

11. A tamper proof cap for use on a container having a threaded annular neck portion and one portion of an interlocking tooth and notch arrangement below the threads, comprising:

a top portion;

a first annular skirt portion depending from the top portion and having internal threads complementary to the threads of the threaded annular neck portion;

a separable strip depending from the bottom of the first skirt portion, the boundary between the first skirt portion and strip being defined by a first line of weakness; and a second annular skirt portion depending from the bottom of the strip, the boundary between the separable strip and second skirt portion defined by a second line of weakness, the second skirt portion having internally the other portion of the tooth and notch arrangement, the notches each being constructed with a first surface extending substantially perpendicularly inward from the circumference of the neck or annular portion wherein the notches are defined and a second surface extending from the circumference of the neck or annular portion to intersect the first surface at substantially a right angle, the notches positioned to allow the teeth to slide past the notches upon rotation of the cap in a threading direction while causing the teeth to engage the notches to prevent rotation of the cap in an unthreading direction.

12. A system for detecting tampering with a capped container, comprising:

(a) a container neck having a threaded annular portion, a notched annular portion below the threaded portion and a projection between the two neck portions, each notch having a first surface extending substantially perpendicularly inward from the circumference of the notched annular portion and a second surface extending from the circumference of the notched annular portion to intersect the first surface at substantially a right angle; and (b) a cap comprising:

a top portion;

a first annular skirt portion depending from the top portion and having internal threads complementary to the threads of the threaded annular portion;

a separable strip depending from the bottom of the skirt portion, the boundary between the skirt portion and the strip defined by a first line of weakness; and a second annular skirt portion depending from the bottom of the strip, the boundary between the strip and second skirt portion defined by a second line of weakness, the second skirt portion having internal teeth for engaging the notches of the notched annular portion, the internal teeth of the second skir portion and the container notches being constructed to allow the teeth to slide past the notches upon rotation of the cap in a threading direction while causing the teeth to engage the notches to prevent rotation of the cap in an unthreading direction, the engagement preventing unthreading of the cap from the container neck until the strip is severed from the cap along the lines of weakness.

* * * * *

UNITED STATES PATENT AND TRADEMARK OFFICE

CERTIFICATE OF CORRECTION

PATENT NO. : 5,111,947
DATED : May 12, 1992
INVENTOR(S) : Michael C. Patterson

It is certified that error appears in the above-indentified patent and that said Letters Patent is hereby corrected as shown below:

Column 8, line 14, change "skir" to --skirt--.

Signed and Sealed this

Twenty-fifth Day of January, 1994

Bruce Lehman

*Attest:*

BRUCE LEHMAN

*Attesting Officer*

*Commissioner of Patents and Trademarks*